United States Patent [19]

Kambara et al.

[11] Patent Number: 4,915,044

[45] Date of Patent: Apr. 10, 1990

[54] CLOTH PRESSER MECHANISM WITH RACK AND PINION NEEDLE ROD-DRIVE

[75] Inventors: Tetsuo Kambara; Hideyuki Kobayashi; Masao Tajima, all of Tochigi, Japan

[73] Assignee: SSMC Inc., Fairfield, N.J.

[21] Appl. No.: 338,669

[22] Filed: Apr. 17, 1989

[30] Foreign Application Priority Data

Jun. 7, 1988 [JP] Japan ..... 63-74793[U]

[51] Int. Cl.[4] ..... D05B 3/02; D05B 55/14

[52] U.S. Cl. ..... 112/236; 112/98; 112/221; 112/311

[58] Field of Search ..... 112/311, 98, 221, 236, 112/443, 235

[56] References Cited

U.S. PATENT DOCUMENTS 4,292,907 10/1981 Gilbride et al. ..... 112/236
4,398,481 8/1983 Gustavsson ..... 112/443
4,438,712 3/1984 Ducellier ..... 112/236 X
4,461,226 7/1984 Tajima ..... 112/311 X

*Primary Examiner*—Andrew M. Falik
*Attorney, Agent, or Firm*—Theodore Jay

[57] ABSTRACT

A cloth presser mechanism comprises a cloth presser vertically movably supported by an arm of a sewing machine. A needle bar is vertically movably supported by the arm of the sewing machine and has a needle at the lower end thereof. The mechanism further includes a rack fixed to the needle bar, a pinion rotatably supported by the arm of the sewing machine and engaged with the rack, a cam integral with the pinion, a first link having an end pivotally supported by the arm of the sewing machine and a middle portion connected to a roller which rides on the surface of the cam, and a second link having an end pivotally supported by the cloth presser. The other end of the second link is pivotally connected to the other end of the first link.

3 Claims, 3 Drawing Sheets

CLOTH PRESSER MECHANISM WITH RACK AND PINION NEEDLE ROD-DRIVE

BACKGROUND OF THE INVENTION

1. Field of the Invention:

The present invention relates to a cloth presser device in an industrial sewing machine.

2. Prior Art:

an industrial sewing machine having a head on which a processed cloth is moved corresponding to predetermined various stitching patterns must allow the processed cloth to be moved freely when the needle is lowered and must prevent the processed cloth from rising upward when the needle is raised. To meet these requirements, the industrial sewing machine normally employs a cloth presser mechanism for pressing the processed cloth during the period when a needle starts to penetrate into and casts off the processed cloth.

In a prior art cloth presser mechanism of this type, a cloth presser supported by an arm of a sewing machine is moved vertically while interlocking with a needle bar movable vertically to restrain the processed cloth from rising upward. More particularly, the prior art cloth presser mechanism employs a pivotable lever pivoted directly by a vertical movement of the needle bar and a link mechanism movable vertically along a cam surface of a cam provided on the pivotable lever for vertically driving the cloth presser.

However, in the prior art cloth presser mechanism, a rotary angle of the pivotable lever is determined by the distance of the vertical movement of the needle bar. As a result the rotary angle of the pivotable lever is limited in such manner that the operation of the cloth presser cannot be stopped because the cam surface even when modified in shape will not produce the control desired. Consequently, the prior art mechanism does not function properly.

In order to solve this problem, a more complex link mechanism has been developed for holding the cloth presser at the lowest position for a long period of time. However, even when such complex link mechanism is employed in the industrial sewing machine, an unpleasant striking noise is generated because of contact between a pin and the cam surface.

SUMMARY OF THE INVENTION

It is an object of the present invention to provide a cloth presser mechanism which overcomes the problems of the prior art cloth presser mechanism.

To achieve the object of the present invention, a cloth presser mechanism comprises a cloth presser supported in a vertically movable manner by an arm of a sewing machine; a needle bar supported in like manner by the arm of the sewing machine, the bar having a needle at the lower end thereof; a rack fixed to the needle bar; a pinion rotatably supported by the arm of the sewing machine and engaged with the rack; a cam integrated with the pinion; a first link having an end pivotally supported by the arm of the sewing machine and a middle portion engagable by a roller with a surface of the cam; a second link having an end pivotally supported by the cloth presser, the other end of the second link being pivotally connected to the other end of the first link.

The above and other bojects, features and advantages of the present invention will become more apparent when the following description is read in conjunction with the accompanying drawings.

PREFERRED EMBODIMENT OF THE INVENTION

Figure 1:
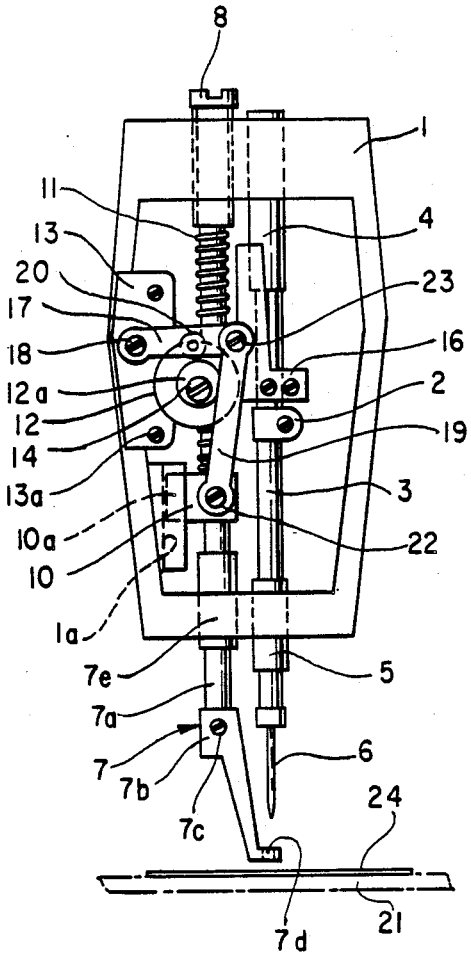
FIG. 1 is a view of a cloth presser mechanism according to a preferred embodiment of the present invention.

A preferred embodiment of a cloth presser mechanism of the present invention is described with reference to FIGS. 1 and 2.

An arm 1 of a sewing machine is fixed to a bed 21. Needle bar 3 is vertically movably supported by the arm 1, an upper bar 4 and a lower bar 5. Bar 3 has a needle 6 at the lower end thereof.

The cloth presser mechanism comprises a cloth presser 7 vertically movably supported by the arm 1 of the sewing machine. Needle bar 3 is secured to the arm 1 of the sewing machine in a vertically movable manner. Needle 6 is secured to the lower end of bar 3. A rack 16 is secured to the needle bar 3. A pinion 12 is rotatably supported by the arm 1 and engages the rack 16. A cam 12*a* is integral with the pinion 12. A first link 17 has an end pivotally supported by the arm 1 and a middle section secured to roller 20 which rides on a cam surface of the cam 12*a*. A second link 19 has an end pivotally supported by the cloth presser 7, the other end being pivotally connected to the other end of the first link 17.

The cloth presser 7 is composed of a cloth presser bar 7*a* vertically movably supported by a cylindrical presser bar 7*e* secured to an end portion of the arm 1. A cloth presser member 7*b* is secured to the lower end of bar 7*e* by screw 7*c*. Member 7*b* is provided at its lower end with a hole 7*d* for receiving needle 6. Press adjusting screw 8 extends through a bore in arm 1 to secure an upper portion of a cloth presser holder 10 in place. Holder 10 secured to bar 7*a* by screw 22 has a projection 10*a* provided at the tip end thereof which engages a longitudinal slit 1*a* of the arm 1 to allow the cloth presser holder 10 to move vertically. A presser spring 11 interposed with pressure between an end of the screw 8 and the cloth presser holder 10 exerts downward pressure on the cloth presser 7. The urging force or resilience force of the presser spring 11 is adjusted by setting an amount or length of the spring to be screwed into the arm 1.

Secured to the front portion of the arm 1 is an attachment plate 13. The pinion 12 integral with the cam 12*a* is rotatably supported on plate 13 by a pin 14. The surface of the cam 12 is so shaped so that when the appropriate portion of the surface of the cam is engaged by roller 20, arm 17 holds the pinion in position to hold the rack stationary whereby the needle 6 can press the processed cloth disposed between the needle 6 and the bed 21 for a long time while it penetrates the cloth.

The rack 16 is positioned above a needle bar holder 2 which holds the needle bar 3 and extends in the axial direction of the needle bar 3. The needle bar holder 2 is connected to an upper shaft via a crank mechanism (not shown) so that the rotary motion of the upper shaft is converted to the vertical movement of the needle rod 3 and the rack 16. The rack 16 engages the teeth 15 of the pinion 12 so that the vertical movement of the rack 16 is converted to the rotary motion of the pinion 12.

The first link 17 is pivotally supported by the attachment plate 13 at the end thereof while the second link 19 is pivotally supported by the cloth presser holder 10 at the end thereof. The first and the second links 17, 18 are pivotally connected to each othe by a pin 23. A roller 20 is fixed to the middle portion of the first link 17 and engages the surface of the cam 12*a*.

An operation of the cloth presser mechanism of the present invention will be described with reference to FIGS. 1, 2 and 3.

At the first state as illustrated in FIG. 1 where the needle 6 is positioned upward and the rack 16 is also positioned upward, the roller 20 contacts the cam surface of the cam 12*a*. This surface has a large radius vector to thereby permit the first link 17 to swing upward about the pin 18 while permitting the cloth presser 7, to swing upward via the second link 19 so that the cloth presser member 7*b* is moved away from the cloth 24. The cloth 24 is not restrained by the cloth presser member 7*b* but can move easily on the bed 21 according to the predetermined various stitching patterns.

Figure 2:
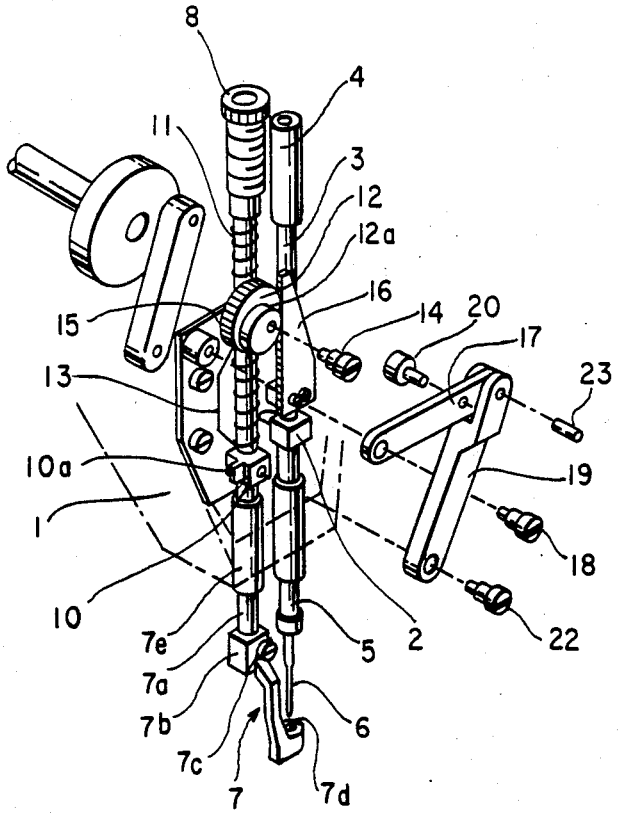
FIG. 2 is an exploded perspective view of the cloth presser mechanism of FIG. 1.

At the second state as illustrated in FIG. 2 where the rack 16 is lowered accompanied by a lowering movement of the needle 6 to rotate the pinion 12 and the cam 12*a* integral with the pinion 12, the roller 20 contacts a different portion of the cam surface of the cam 12*a*. This portion has a small radius vector, thereby permitting the first link to swing downward to lower the cloth presser 7 downward so that the cloth 24 is pressed by the cloth presser member 7*b* between the lower end of the cloth presser member 7*b* and the bed 21. At this state, during the period when the needle 6 starts to penetrate the cloth 24 and casts off the cloth 24, especially during the period when the needle 6 reaches the lowest portion and an upper thread is cast off a hook, the cloth presser member 7*b* is held in position whereby the cloth 24 is restrained from rising upward and can be stitched as desired. The contact of the cam surface of the cam 12*a* with the roller 20 of the first link 17 is established positively by the presser spring 11. When cam 12*a* is a positive cam, it may be possible to omit use of spring 11.

Figure 3:
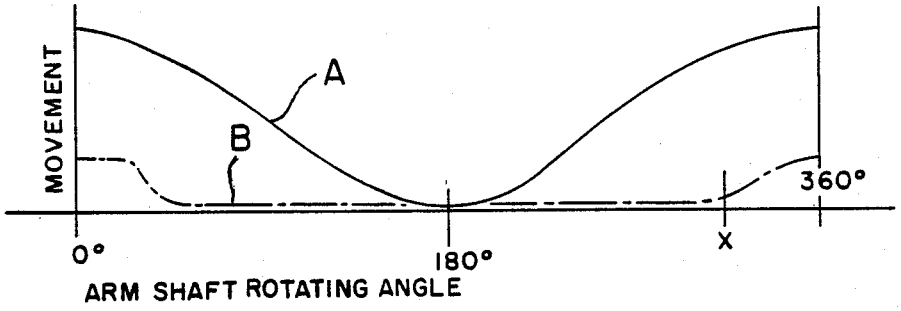
FIG. 3 is a graph of the movement of the needle as a function of the angle of rotation of the arm shaft.

Each operation characteristic of the needle 6 and the cloth presser member 7*b* is illustrated in FIG. 3.

An operation characteristic, namely, the relationship of the movement of the needle 6 with respect to the movement of the cloth presser member 7*b* (abscissa) relative to a rotary angle (ordinate) is shown in FIG. 3 wherein the solid line A illustrates the movement of the needle 6 and the dotted line B illustrates the corresponding movement of the cloth presser member 7*b*.

The needle 6 is lowered at the rotary angle (0 degrees) of the upper shaft while the cloth presser member 7*b* starts to lower gradually just after the lowering of the needle 6. The rotary angle of the cam 12*a* becomes maximum at the angle near the rotary angle (180 degrees) of the cam 12*a* where the neddle 6 and the cloth presser member 7*b* are lowered at the lowest position. Thereafter, the needle starts to rise while the cloth presser member 7*b* is kept in the lowest position for a long period of time even if the cam 12*a* starts to reversely rotate so that the cloth 24 is restrained from rising and the cloth presser member 7*b* rises at the angle near the rotary angle where the needle 6 completes the penetration of the cloth 24.

With the arrangement of the cloth presser mechanism of the present invention, the rack 16 is moved upward when the needle 6 is moved upward thereby raising the first link 17 which contacts the cam surface of the cam 12*a* integral with the pinion 12 whereby the cloth presser 7 can be moved away from the cloth 24 since the second link 19 is moved upward with the interlocking motion with the first link 17. As a result, the cloth 24 placed on the bed 21 can be moved freely with ease in accordance with the predetermined various stitching patterns. In the second step where the needle 6 is lowered, when the rack 16 rises after completion of lowering motion thereof, the cam 12*a* integrated with the pinion 12 is rotated within one rotation so that the second link 19 is pivotally lowered with interlocking motion with the first link 17, thereby permitting the cloth presser 7 to press the cloth 24 between the lower end of the cloth presser member 7*b* and the bed 21. As a result, during the period when the needle starts to penetrate the cloth 24 and casts off the cloth 24, especially when the needle 6 reaches the lowest position and casts off the cloth 24, the cloth presser member 7*b* is kept at the lowest position to permit the cloth presser to contact the cloth 24 and restrain the cloth from rising so that it can be stitched properly.

Thus in accordance with the present invention, the vertical movement of the needle bar 3 is converted to the rotary motion of the cam 12*a* via the rack 16 and the pinion 12, and the rotary angle of the cam 12*a* is set to an arbitrary angle with one rotation of the cam 12*a* for allowing the cloth presser member 7*b* to move vertically in accordance with the gradual variation in the cam contour. As a result, the striking noise caused by the engagement of the cam 12*a* by the first link 17 can be diminished. Furthermore, the modification of the cam shape makes it possible to vary the duration and the amount or the distance of the vertical movement of the cloth presser member 7*b*.

Although the invention has been described in its preferred form with a certain degree of particularity, it is to be understood that many variations and changes are possible in the invention without departing from the scope thereof.

What is claimed is:

1. A cloth presser mechanism adapted for connection to the arm of a sewing machine and comprising a cloth presser vertically movably supported by said arm;

a needle rod vertically movably supported by said arm having a needle at the lower end thereof;

a rack secured to the needle rod;

a pinion rotatably supported by the arm of the sewing machine and engaged with the rack;

a cam integral with the pinion;

a first link having a first end pivotally mounted on the arm of the sewing machine, a middle portion and a second end;

a second link having one end pivotally supported by the cloth presser and an opposite end pivotally connected to the second end of the first link; and means connected to the middle portion of the first link and engaging the surface of the cam.

2. The mechanism as set forth in claim 1 wherein said means is a roller.

3. The mechanism as set forth in claim 2 further including a vertical cloth presser bar supported at an upper end to said arm;

a cloth presser member having an upper end coupled to the lower end of the bar and a lower end with a needle hole therein, the hole being positioned so that the needle can pass therethrough.

* * * * *